US006889639B2

(12) United States Patent
Diehl et al.

(10) Patent No.: US 6,889,639 B2
(45) Date of Patent: May 10, 2005

(54) DEVICE FOR CONTROLLING GAS EXCHANGE VALVES

(75) Inventors: Udo Diehl, Stuttgart (DE); Bernd Rosenau, Tamm (DE); Uwe Hammer, Hemmingen (DE); Volker Beuche, Stuttgart (DE); Peter Lang, Weissach (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/381,273

(22) PCT Filed: May 23, 2002

(86) PCT No.: PCT/DE02/01868

§ 371 (c)(1),
(2), (4) Date: Aug. 13, 2003

(87) PCT Pub. No.: WO03/012263

PCT Pub. Date: Feb. 13, 2003

(65) Prior Publication Data

US 2004/0035379 A1 Feb. 26, 2004

(30) Foreign Application Priority Data

Jul. 24, 2001 (DE) ..... 101 36 020

(51) Int. Cl.[7] ..... F01L 9/02

(52) U.S. Cl. ..... 123/90.12; 123/90.15; 91/52

(58) Field of Search ..... 123/90.12, 90.15, 123/90.16, 90.17, 90.33, 90.48–90.59; 91/52, 374, 378, 365, 469

(56) References Cited

U.S. PATENT DOCUMENTS 4,009,695 A * 3/1977 Ule ..... 123/90.13
5,231,959 A * 8/1993 Smietana ..... 123/90.12

* cited by examiner

*Primary Examiner*—Thomas Denion
*Assistant Examiner*—Jaime Corrigan
(74) *Attorney, Agent, or Firm*—Ronald E. Greigg

(57) ABSTRACT

An apparatus for controlling gas exchange valves of an internal combustion engine having hydraulic valve actuators each assigned to one gas exchange valve, with one adjusting piston acting on the gas exchange valve and two hydraulic work chambers defined by the adjusting piston the first work chamber acting on the gas exchange valve in the closing direction being constantly filled with fluid that is under pressure, and the second work chamber acting on the gas exchange valve in the opening direction can be filled with and relieved of fluid that is under pressure in alternation via a first and second electrical control valve. Two valve actuators are each triggered in alternation by the same first and the same second control valve, and the switchover of the control valves is performed during the closing state of the two gas exchange valves actuated by these valve actuators.

19 Claims, 2 Drawing Sheets

DEVICE FOR CONTROLLING GAS EXCHANGE VALVES

CROSS-REFERENCE TO RELATED APPLICATIONS

This application is a 35 USC 371 application of PCT/DE 02/01868 filed on May 23, 2002.

BACKGROUND OF THE INVENTION

1. Field of the Invention

The invention is based on an apparatus for controlling gas exchange valves in combustion cylinders of an internal combustion engine.

2. Description of the Prior Art

In a known apparatus of the type with which this invention is concerned. (German Patent Disclosure DE 198 26 047 A1), each valve actuator, whose adjusting piston is connected integrally to the valve tappet of the associated gas exchange valve, communicates constantly by its first work chamber with a high-pressure source and with its second work chamber on the one hand is connected to a first electrical control valve that in alternation closes or opens a supply line to the high-pressure source and on the other to a second control valve that alternately opens or closes a relief line. The electrical control valves are embodied as 2/2-way magnet valves with spring restoration. When the control valves are without current, the first work chamber is at high pressure as before, while the second work chamber is disconnected from the high-pressure source and is connected to the relief line. The gas exchange valve is closed. For opening the gas exchange valve, both control valves are supplied with current. Because of the switchover of the control valves, the second work chamber of the valve actuator is blocked on the one hand from the relief line by the second control valve and on the other is made to communicate, by the first control valve, with the supply line to the high-pressure source. The gas exchange valve opens; the length of the opening stroke depends of the electrical control signal applied to the first electrical control valve, and the opening speed depends on the pressure fed in from the high-pressure source. To keep the gas exchange valve in a defined open position, the first control valve is then switched to be without current, so that it blocks off the supply line to the second work chamber of the valve actuator. In this way, by means of an electrical control unit for generating control signals, all the valve opening positions of the gas exchange valve can be set. For controlling each gas exchange valve, two electrical control valves are required, which correspondingly subject the associated valve actuator to hydraulic pressure.

SUMMARY OF THE INVENTION

The apparatus according to the invention for controlling gas exchange valves has the advantage that by using a pair of control valves, composed of a first and a second electrical control valve, for triggering a total of two valve actuators in alternation, two fewer electrical control valves per pair of valve actuators are needed. Since the electrical control valves, predominantly embodied as 2/2-way magnet valves, must achieve extremely short switching times, in practice of approximately 0.3 ms for an opening cross section of 3 $mm^2$, such control valves are very expensive, and so reducing the number of control valves in the control system means a significant cost reduction. Because of the lower number of electrical control valves, the number of end stages and the expense for electrical cabling for triggering the control valves are also reduced, leading to further cost reductions.

In a preferred embodiment of the invention, the switchover of the control valves is performed by means of two switchover valves embodied as 3/2-way valves; of their three controlled valve connections, the first is connected to the first and second electrical control valve, respectively, and the two further valve connections that can be connected in alternation to the first valve connection are connected to the second work chambers of the two valve actuators. Simple switchover valves that can be triggered electrically or hydraulically, being mass-produced articles, are very inexpensive, especially if fast switching times are not needed. Since in a 4-cylinder, 4-stroke engine, for instance, the common closing state of two gas exchange valves in combustion cylinders, with a 360° crank angle offset of their instants of ignition, extends over a crank angle range of about 60°, a sufficiently long period of time is available for reversing the switchover valves. Although the use of the inexpensive switchover valves does increase the number of valves in all, nevertheless there is still a significant potential cost reduction. The switchover valves, especially if they are triggered hydraulically, are quite small in comparison to 2/2-way magnet valves, so that even the installation space required for the valve control system is reduced compared to the known valve controller.

In an advantageous embodiment of the invention, a hydraulic pressure is permanently present at the control inlet of the hydraulically controlled switchover valves, and this pressure is increased in order to reverse the switchover valves to their working position by means of a reciprocating piston. For that purpose, the reciprocating piston can be driven to reciprocate in a pressure chamber communicating with the respective control inlet by means of a cam that revolves at half the rpm of the crankshaft. With this structural provision, the switchover of the switchover valves is synchronized with the crankshaft rotation in a simple way.

BRIEF DESCRIPTION OF THE DRAWINGS

The invention is described below in further detail herein below, in conjunction with the drawings, in which.

DESCRIPTION OF THE PREFERRED EMBODIMENTS

Figure 1:
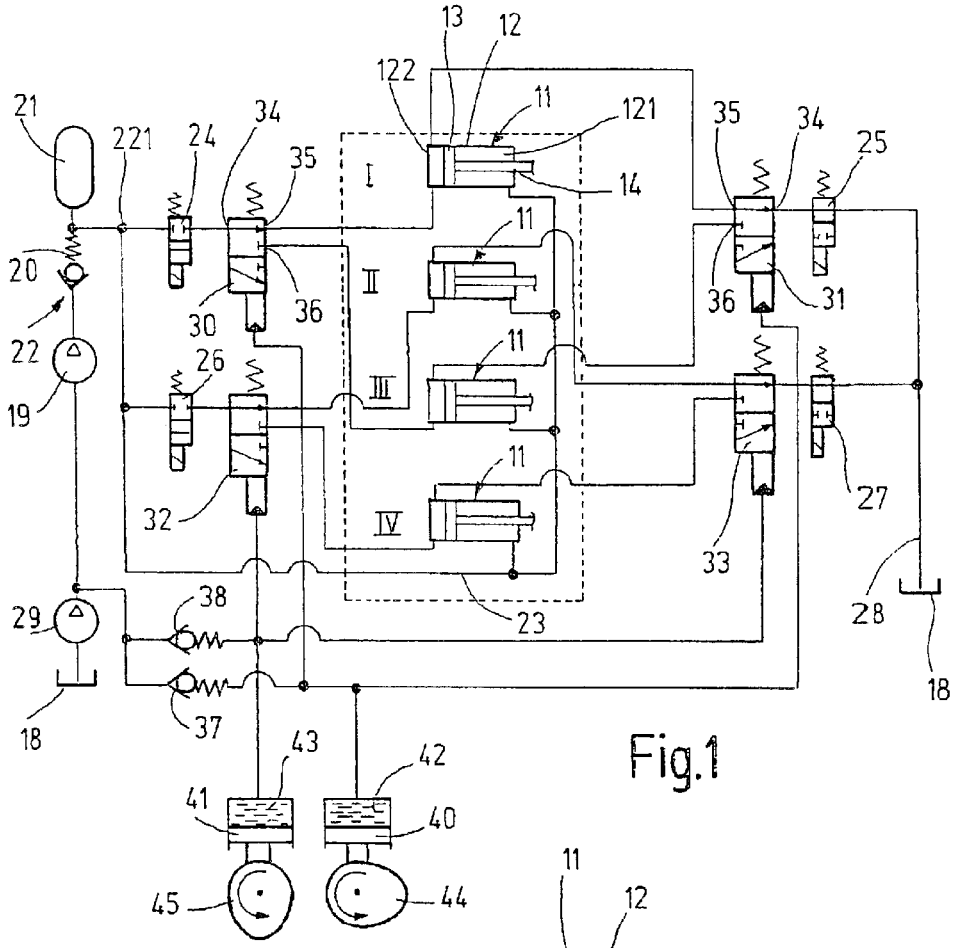
FIG. 1, a circuit diagram of an apparatus for controlling four gas exchange valves, disposed in different combustion cylinders of a 4-cylinder engine.

The apparatus shown in a circuit diagram in FIG. 1 for controlling gas exchange valves in combustion cylinders of an internal combustion engine is used to control a total of four gas exchange valves 10 (FIG. 2), one of which is disposed in each combustion cylinder of a 4-cylinder, 4-stroke engine. The gas exchange valves 10 can be either the inlet valves or the outlet valves of the combustion cylinders. The combustion cylinders, not shown here, are symbolically indicated by I, II, III and IV, which in FIG. 1 are associated with the valve actuators 11 for the gas exchange valves 10 of the respective combustion cylinder.

Figure 2:
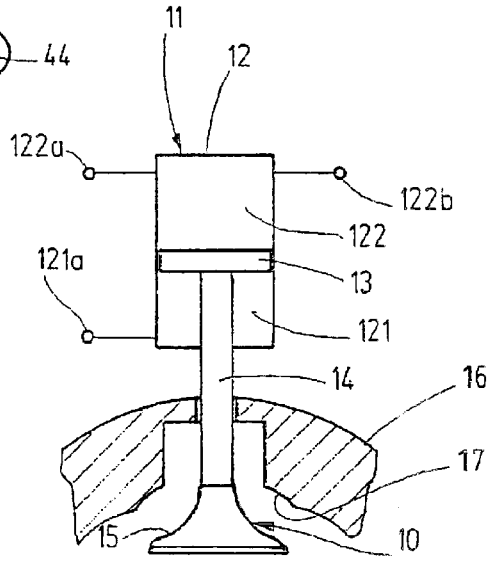
FIG. 2, a schematic illustration of a gas exchange valve in a combustion cylinder of the engine.

The apparatus has a total of four hydraulic valve actuators 11, each of which is assigned to one gas exchange valve 10 in the combustion cylinders I–IV. Each valve actuator 11 has one work cylinder 12, in which an adjusting piston 13 is guided axially displaceably. The adjusting piston 13 divides the work cylinder 12 into two hydraulic work chambers 121 and 122, defined by the work cylinder, and is solidly connected to the valve tappet 14 of the gas exchange valve 10. FIG. 2, in an enlarged illustration, schematically shows a valve actuator 11 in conjunction with a gas exchange valve 10. The valve tappet 14, on its end remote from the adjusting piston 13, has a platelike valve sealing face 15, which to control an opening cross section cooperates with a valve seat face 17 embodied on the housing 16 of the combustion cylinder of the engine. The work cylinder 12 has a total of three hydraulic connections, of which two hydraulic connections 122*a* and 122*b* discharge into the second work chamber 122, and one hydraulic connection 121*a* discharges into the first work chamber 121.

The apparatus also has a pressure supply system 22, which comprises a fluid reservoir 18, a prefeed pump 29, a high-pressure pump 19, a check valve 20, and a reservoir 21 for pulsation damping and energy storage. The outlet 221 of the pressure supply system 22 that is tapped between the check valve 20 and the reservoir 21 communicates via a line 23 with all of the hydraulic connections 121*a* of the four valve actuators 11, so that the first work chambers 121 of the valve actuators 11 are acted upon constantly by the hydraulic pressure prevailing at the outlet 221 of the pressure supply system 22.

The second work chambers 122 of the work cylinders 12 can be connected on the one hand, via first electrical control valves 24 and 26, to the outlet 221 of the pressure supply system 22 and on the other, via second electrical control valves 25 and 27, to a relief line 28, which in turn discharges into the fluid reservoir 18. All the control valves 24–27 are embodied as 2/2-way magnet valves with spring restoration. One first control valve 24 or 26 and one second control valve 25 or 27 each form one control valve pair, and each pair triggers two valve actuators 11 at a time in alternation. The two valve actuators 11 triggered by the pairs of control valves 24, 25 and 26, 27, respectively, are each assigned to gas exchange valves 10 in those combustion cylinders whose instants of ignition are offset from one another by 360° crank angle. Thus the control valve pair 24, 25 triggers the two valve actuators 11 of the gas exchange valves 10 in the first and third combustion cylinders I and III, and the control valve pair 26, 27 triggers the valve actuators 11 for the gas exchange valves 10 in the second and fourth combustion cylinders II and IV; the control of the respective two valve actuators 11 is effected in alternation, and the switchover of the control valve pair 24, 25 and 26, 27, respectively, from one valve actuator 11 to the other valve actuator 11 is performed during the closing state of the two gas exchange valves 10 actuated by the valve actuators 11. The switchover of the two control valves 24 and 25, and 26 and 27, of each control valve pair is effected synchronously.

Switching over the two pairs of control valves 24, 25; 26, 27 from one valve actuator 11 to the other valve actuator ills effected by switchover valves 30–33, which in the exemplary embodiment of FIG. 1 are embodied as hydraulically controlled 3/2-way valves with spring restoration. Each switchover valve 30–33 has two switching positions and three controlled valve connections 34–36, of which the first valve connection 34 is connected to the respectively associated control valves 24 and 25; 26 and 27, and the two further valve connections 35 and 36 that can be connected to the first valve connection 34 are connected to the second work chambers 122 of the valve actuators 11. Thus in the switchover valve 30, the first valve connection 34 is connected to the first control valve 24; the second valve connection 35 is connected to the second work chamber 122 of the valve actuator 11 for the first combustion cylinder I; and the third valve connection 36 is connected to the second work chamber 122 of the valve actuator 11 for the third combustion cylinder III. The first valve connection 34 of the switchover valve 31 is connected to the second control valve 25; the second valve connection 35 is connected to the second work chamber 122 of the valve actuator 11 for the first combustion cylinder I; and the third valve connection 36 is connected to the work chamber 122 of the valve actuator 11 for the third combustion cylinder III. The same is correspondingly true for the switchover valves 32, 33 in conjunction with the pair 26, 27 of control valves and the valve actuators 11 for the second and fourth combustion cylinders II and IV.

The control of the switchover valves 30–33 is effected hydraulically counter to the spring force of a restoring spring; to that end, the control inlets of the switchover valves 30 and 31 communicate with the outlet of the prefeed pump 29 via a check valve 37, and the control inlets of the switchover valves 32 and 33 communicate with that outlet via a check valve 38. The switchover valves 30–33 are designed such that they cannot be moved out of their position of repose shown in FIG. 1 by the hydraulic pressure prevailing at the outlet of the prefeed pump 29. For switching the switchover valves 30–33, the hydraulic pressure at the control inlets of the switchover valves 30–33 is increased by means of the reciprocating pistons 40 and 41. Each reciprocating piston 40 and 41 defines a fluid-filled pressure chamber 42 and 43, respectively, communicating with the outlet of the prefeed pump 29 and is driven to reciprocate by a respective cam 44 and 45. The pressure chamber 42 communicates with the control inlets of the switchover valves 30 and 31, and the pressure chamber 43 communicates with the control inlets of the switchover valves 32, 33. The two cams 44, 45 revolve at half the rpm of the crankshaft, and upon each cam revolution, the hydraulic pressure prevailing at the control inlets increases from the pressure level at the outlet of the prefeed pump 29 to a maximum pressure required for switching over the switchover valves 30–33 and is then reduced again to the original pressure level. By displacement of the pistons 40 and 41. upward in terms of FIG. 1, the pressure is increased, and the associated switchover valves 30–33 switch over. The restoration of the pistons 40, 41, is effected by the restoring force of the restoring springs of the switchover valves and by the permanently applied pressure of the prefeed pump 29. The prefeed pump 29 likewise serves to compensate for leakage losses.

Figure 3:
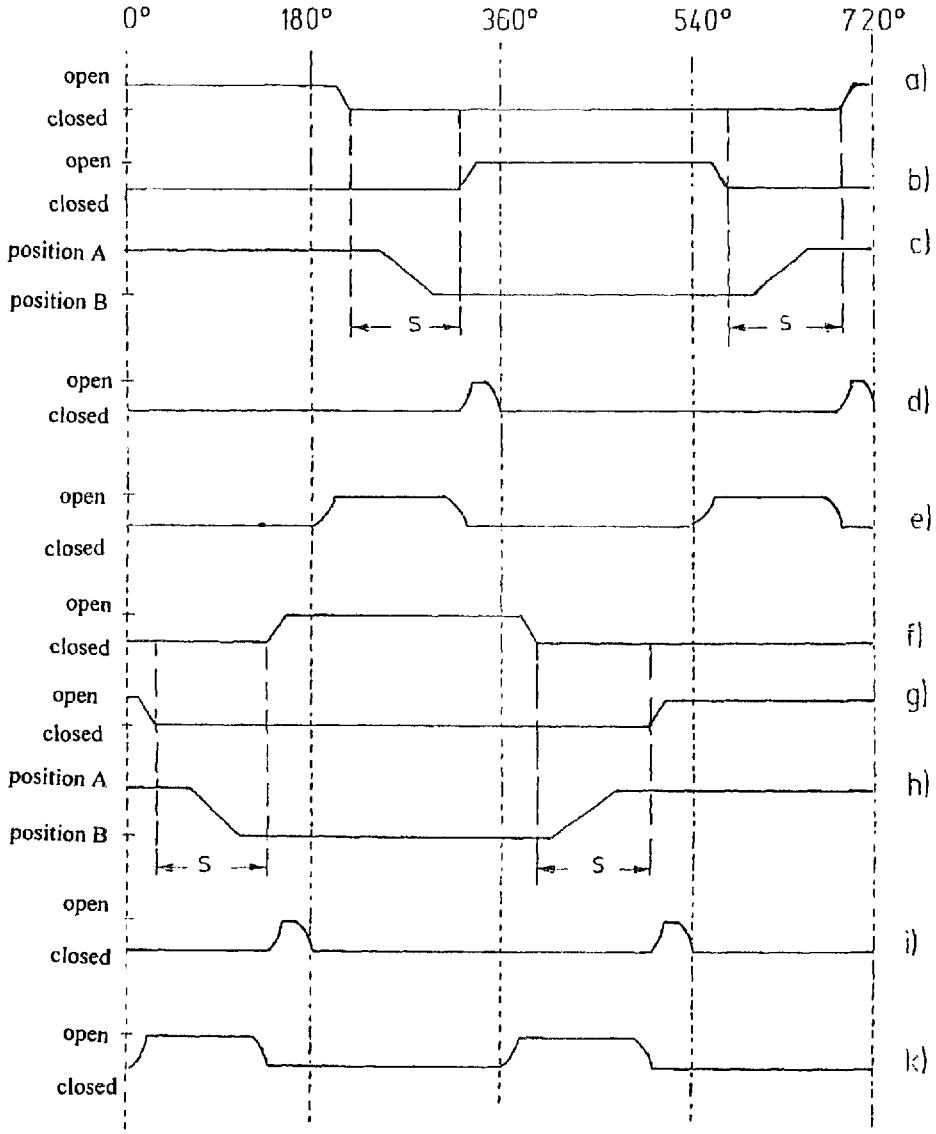
FIG. 3, a graph of the valve stroke of various valves in the apparatus of FIG. 1, as a function of the crank angle.

The mode of operation of the apparatus described will now be described in detail in conjunction with FIG. 3. FIG. 3 show the valve stroke as a function of the crank angle for the various valves. Graphs a, b, f and g each show the valve stroke of the gas exchange valves 10, which in this case form inlet valves, in the first, third, second and fourth combustion cylinders I, III, II and IV; graph c shows the valve stroke of the switchover valves 30, 31; graph h shows the valve stroke of the switchover valves 32 and 33; graph d shows the valve stroke of the control valve 24; graph e shows the valve stroke of the control valve 25; graph i shows the valve stroke of the control valve 26; and graph k shows the valve stroke of the control valve 27.

In principle, each gas exchange valve 10 is controlled by the associated valve actuator 11 in such a way that for closure of the gas exchange valve 10, the second work chamber 122 of the valve actuator 11 is connected to the relief line 28 via the second electrical control valve 25 and 27, respectively and is blocked off from the outlet 221 of the pressure supply system 22 via the first electrical control valve 24 and 26, respectively. As a result of the system pressure prevailing in the first work chamber 121 of the valve actuator 11, the adjusting piston 13 is displaced upward in terms of FIG. 2, until the valve sealing face 15 of the gas exchange valve 10 rests on the valve seat face 17 on the housing 16 of the combustion cylinder of the engine. The adjusting piston 13 assumes the position inside the work cylinder 12 of the valve actuator 11 as shown in FIG. 1. All the control valves 24–27 are without current and assume their basic position, or position of repose. For opening the gas exchange valve 10, the second electrical control valve 25 and 27, respectively, is transferred to its blocking position, in which the second work chamber 122 is blocked off from the relief line 28, and the first electrical control valve 24 and 26, respectively, is transferred to its working position, so that the second work chamber 122 communicates with the outlet 221 of the pressure supply system 22, and the system pressure now prevails in the second work chamber 122 of the valve actuator 11 as well. Since the piston face of the adjusting piston 13 that defines the first work chamber 121 is smaller than the face of the adjusting piston 13 that defines the second work chamber 122, the result is a displacement force that moves the adjusting piston 13 to the right in FIG. 1 or downward in FIG. 2, as a result of which the gas exchange valve 10 is opened. The length of the opening stroke of the gas exchange valve 10 is dependent on the opening duration and opening speed of the first control valve 24 and 26, respectively.

Once the desired stroke of the gas exchange valve 10 is reached, the current supply to the first control valve 24 and 26, respectively, is discontinued, and the first control valve 24 and 26 returns to its blocking position. The pressure in the second work chamber 122 is maintained, so that the gas exchange valve 10 maintains its assumed opening stroke unchanged. For closing the gas exchange valve 10, the second control valve 25 and 27 is then switched to be without current. Graph d shows the triggering of the first control valve 24, and graph e shows the triggering of the second control valve 25. Graph i shows the triggering of the first control valve 26, and graph k shows the triggering of the second control valve 27. The first control valves 24 and 26 are blocked when without current, while the second control valves 25, 27 are open when without current.

For controlling the valve actuator 11 associated with the gas exchange valve 10 in the combustion cylinder I, the switchover valves 30, 31 are in the position of repose or basic position A shown in FIG. 1, as shown in graph c in FIG. 3. The valve stroke of the gas exchange valve 10 in the cylinder I is shown as a function of the crank angle in graph a.

For triggering the valve actuator 11 for actuating the gas exchange valve 10 associated with the third combustion cylinder III, the two switchover valves 30, 31 are switched over to their working position B. As a result, the second work chamber 122 of the valve actuator 11, for actuating the gas exchange valve 10 in the third combustion cylinder III, is connected to the two control valves 24, 25. The valve control operation for the gas exchange valve 10 in the combustion cylinder III then proceeds in the same way as described above for combustion cylinder I. Graph b shows the stroke of the gas exchange valve 10 in the combustion cylinder III as a function of the crank angle, while the switchover valves 30, 31 are in position B (graph c). As can be seen from graphs a, b and c, the instants of closure of the gas exchange valves 10 in the combustion cylinders I and III, which correspond approximately to the instants of ignition in the combustion cylinders I and III, are offset by 360° crank angle. At a maximum opening angle of the gas exchange valves 10 of approximately 240° there is enough time available for switching over the two switchover valves 30, 31 in the crank angle range in which the two gas exchange valves 10 in the cylinders I and III are closed. This switchover range is marked S in graph c and covers a crank angle of approximately 60°.

In the lower part of FIG. 3, graphs f–k show the corresponding conditions for controlling the gas exchange valves 10 in the combustion cylinders II and IV. These graphs correspond to the graphs a–e described above and are merely displaced by a crank angle of 180°. To that extent, the above remarks also apply to the control valves 26 and 27 in conjunction with the switchover valves 32, 33.

As seen from graphs c and h in FIG. 3, the switchover valves 30, 31; 32, 33 are each in position A and in position B over a crank angle range of approximately 300°. The corresponding switchover is effected by the cams 44, 45, which rotate at half the crankshaft rpm.

The invention is not limited to the exemplary embodiment described. For instance, the switchover valves can be actuated not hydraulically but electrically, and the currentless switchover valve can assume position A while the switchover valve with current assumes position B, or vice versa. It is also possible, with the hydraulically controlled switchover valves 30–33 described, to provide, instead of the spring restoration, a second hydraulic control inlet that acts counter to the first.

The foregoing relates to preferred exemplary embodiments of the invention, it being understood that other variants and embodiments thereof are possible within the spirit and scope of the invention, the latter being defined by the appended claims.

What is claimed is:

1. An apparatus for controlling gas exchange valves in combustion cylinders of an internal combustion engine, the apparatus comprising a plurality of hydraulic valve actuators (11) each assigned to one gas exchange valve (10), each valve actuator (11) having one adjusting piston (13) acting on the gas exchange valve (10) and two hydraulic work chambers (121, 122) defined by the adjusting piston (13), the first work chamber (121), acting on the gas exchange valve (10) in the closing direction and being constantly filled with a fluid that is under pressure, the second work chamber (122) acting on the gas exchange valve (10) in the opening direction, can be filled with and relieved of a fluid that is under pressure in alternation via a first and second electrical control valve (24 and 25; 26 and 27), two valve actuators (11) at a time are triggered by the same first control valve (24 and 26, respectively) and the same second control valve (25 and 27, respectively), and the switchover of the first and second control valves (24 and 25; 26 and 27) from one valve actuator (11) to the other is performed during the closing state of the two gas exchange valves (10) actuated by these valve actuators (11).

2. The apparatus of claim 1, wherein the two valve actuators (11) triggered by the same control valves (24, 25; 26, 27) are each assigned to one gas exchange valve (10) in those combustion cylinders (I, III; II, IV) whose ignition instants are offset from one another by 360° crank angle.

3. The apparatus of claim 2, wherein the switchover of the control valves (24, 25; 26, 27) from one valve actuator (11) to the other is effected synchronously.

4. The apparatus of claim 2, wherein the gas exchange valves (10) are used as in let and/or outlet valves for the combustion cylinders of the engine.

5. The apparatus of claim 1, wherein the switchover of the control valves (24, 25; 26, 27) from one valve actuator (11) to the other is effected synchronously.

6. The apparatus of claim 5, wherein the gas exchange valves (10) are used as inlet and/or outlet valves for the combustion cylinders of the engine.

7. The apparatus of claim 1, wherein the switchover of the control valves (24, 25; 26, 27) is performed in each case by means of two switchover valves (30, 31; 32, 33) embodied as 3/2-way valves each having two switching positions and three controlled valve connections (34, 35, 36), of which a first valve connection (34) is connected to the first and second electrical control valve (24 and 25, respectively), and two further valve connections (35, 36), which can be connected to the first valve connection (34), are connected to the second work chambers (122) of the two valve actuators (11).

8. The apparatus of claim 7, wherein the switchover valves (30–33) each comprise one hydraulic control inlet with spring restoration wherein a permanent hydraulic pressure occurs at the control inlet of the switch over valves (30–33), and wherein the hydraulic pressure is variable by means of a reciprocating piston (40, 41), which can be driven by a cam (44, 45) that revolves at half the crankshaft rpm.

9. The apparatus of claim 8, wherein the control inlets of the switchover valves (30–33) are each connected via a respective check valve (37, 38) to a pressure source, preferably embodied as a prefeed pump (29), that furnishes a constant hydraulic pressure, and that the spring force of the spring restoration is adjusted such that the restoring force that it generates is not as great as the valve switchover force generated at the control inlet by the hydraulic pressure of the pressure source.

10. The apparatus of claim 9, wherein the two switchover valves (30, 31; 32, 33) assigned to the respective two valve actuators (11) are combined into a valve unit with one common hydraulic control unit with spring restoration.

11. The apparatus of claim 8, wherein the two switchover valves (30, 31; 32, 33) assigned to the respective two valve actuators (11) are combined into a valve unit with one common hydraulic control unit with spring restoration.

12. The apparatus of claim 8, wherein the gas exchange valves (10) are used as inlet and/or outlet valves for the combustion cylinders of the engine.

13. The apparatus of claim 7, wherein the gas exchange valves (10) are used as inlet and/or outlet valves for the combustion cylinders of the engine.

14. The apparatus of claim 1, wherein the switchover valves (30–33) each comprise one hydraulic control inlet with spring restoration.

15. The apparatus of claim 14, wherein the two switchover valves (30, 31; 32, 33) assigned to the respective two valve actuators (11) are combined into a valve unit with one common hydraulic control unit with spring restoration.

16. The apparatus of claim 15, wherein the gas exchange valves (10) are used as inlet and/or outlet valves for the combustion cylinders of the engine.

17. The apparatus of claim 1, wherein the switchover of the switchover valves (30–33) is derived from the rotary motion of a crankshaft of the engine.

18. The apparatus of claim 17, wherein the two switchover valves (30, 31; 32, 33) assigned to the respective two valve actuators (11) are combined into a valve unit with one common hydraulic control unit with spring restoration.

19. The apparatus of claim 1, wherein the gas exchange valves (10) are used as inlet and/or outlet valves for the combustion cylinders of the engine.

* * * * *